US008511495B2

(12) United States Patent
Grigsby et al.

(10) Patent No.: US 8,511,495 B2
(45) Date of Patent: Aug. 20, 2013

(54) RAMPABLE CRATE FOR WHEELED VEHICLES AND METHOD

(75) Inventors: Charles F. Grigsby, Marietta, GA (US); Jeffrey C. Banks, Austell, GA (US)

(73) Assignee: North American Container Corporation, Mableton, GA (US)

( * ) Notice: Subject to any disclaimer, the term of this patent is extended or adjusted under 35 U.S.C. 154(b) by 1302 days.

(21) Appl. No.: 11/939,298

(22) Filed: Nov. 13, 2007

(65) Prior Publication Data

US 2009/0120906 A1 May 14, 2009

(51) Int. Cl.

| | |
|---|---|
| ***B65D 6/00*** | (2006.01) |
| ***B65D 25/22*** | (2006.01) |
| ***B65D 85/68*** | (2006.01) |
| ***A47F 7/00*** | (2006.01) |

(52) U.S. Cl.

USPC ..... 220/6; 220/475; 211/85.8; 206/335

(58) Field of Classification Search

USPC ..... 220/6, 475, 504, 1.5, 8, 4.03, 4.28; 410/4, 6; 206/335; 217/36; 211/85.8, 194, 211/21, 23, 24; 108/55.1

See application file for complete search history.

(56) References Cited

U.S. PATENT DOCUMENTS

| | | | | |
|---|---|---|---|---|
| 5,133,453 | A * | 7/1992 | Fritze | 206/335 |
| 5,772,026 | A * | 6/1998 | Grigsby | 206/335 |
| 6,513,442 | B1 * | 2/2003 | Miller et al. | 108/53.1 |
| 6,585,126 | B1 | 7/2003 | Grigsby, Sr. et al. | |
| 6,726,041 | B2 | 4/2004 | Dunn | |
| 6,938,557 | B1 | 9/2005 | Grigsby, Jr. | |
| 7,011,223 | B1 | 3/2006 | Grigsby, Jr. | |
| 7,097,054 | B2 * | 8/2006 | Beck | 206/335 |
| 7,152,749 | B2 | 12/2006 | Beck | |

* cited by examiner

*Primary Examiner* — Bryon Gehman
*Assistant Examiner* — Shawn Braden
(74) *Attorney, Agent, or Firm* — Baker Donelson Bearman Caldwell & Berkowitz, PC

(57) ABSTRACT

A rampable crate for riding lawn mowers in which a pallet connects to a top frame with a plurality of posts, and the pallet includes a pair of spaced-apart rails disposed at an oblique angle as an upward ramp to an edge of the pallet for travel of the rear wheels of the riding lawn mower with the posts selectively extending from the edge of the pallet to define a downward ramp from the pallet in order for the lawn mower to be driven off the pallet. A method of removing a riding lawn mower from a crate is disclosed.

10 Claims, 4 Drawing Sheets

RAMPABLE CRATE FOR WHEELED VEHICLES AND METHOD

TECHNICAL FIELD

The present invention relates to crates and methods for storing and shipping heavy durable equipment. More particularly the present invention relates to crates selectively configured for storing and shipping riding lawn mowers and for removing a contained lawn mower by rolling on a ramp extending from the crate and methods for storing riding lawn mowers in crates and removing stored riding lawn mowers from crates.

BACKGROUND OF THE INVENTION

Manufacturers of heavy durable equipment such as lawn mowers, lawn and garden tractors, riding lawn mowers, and the like equipment, package the products in containers for storage and shipping. There are different types of containers used for packaging such equipment including walled cleated containers such as corrugated paperboard wood-cleated containers, and frame-member crates that use wood or steel tube members connected together to form a crate. These containers and crates are referred to generally as containers. Generally, the containers include a pallet, or base, which supports the article within the containers. Posts extend vertically from the pallet and receive or connect to a top frame. The pallet, the posts, and the top frame define a cavity or space which is occupied by the article positioned on the pallet. Some such containers include corrugated paperboard sidewalls or panels. Top flaps foldably attach to the panels to close the open top end of the container. Other of these panel-wall containers use a cap that seats over the upper end of the posts or on the top frame to close the container.

The containers use the posts to define the interior space to be occupied by the equipment, as well as to communicate top-load compression forces incurred by stacking two or more such containers, for example, in a warehouse for storage or in a truck for shipping. The top frame facilitates the transfer of the top load force through the posts to the pallet.

While corrugated paperboard wood-cleated crates have been particularly useful for packaging lawn and garden tractors, some manufacturers have preferred to use frame-type packing crates that assemble from elongate wood or steel tube members. Because such crates lack sidewalls, articles held in such frame crates are typically enclosed in plastic sheeting to prevent infiltration of dust and dirt to the equipment.

At a packing station of a lawn mower manufacturing plant, a finished lawn riding mower is placed on the pallet. This typically involves using an overhead hoist to lift the riding lawn mower over the pallet and then lower the lawn mower onto the pallet. As an alternative, the riding lawn mower could be pushed or driven onto the pallet in the packaging station. It is to be appreciated that wheeled articles placed on pallets of containers can be readily secured to the pallet, such as by straps or connectors, for example, the tie-down device disclosed in U.S. Pat. No. 6,293,398. Articles with spring suspensions particularly can be strapped in place, while riding lawn mowers generally do not require strapping.

Subsequently, containerized lawn mowers are typically stacked together for storage in warehouses, and for shipping from warehouses to retail outlets. Known crates use a variety of structural elements to facilitate stacking of two crates for handling, storing, and shipping.

Further, to conserve space and reduce the likelihood of tipping, the center of gravity of the container and the contained equipment should be as low relative to the container. However, the rear wheels of riding lawn mowers typically are larger than the front wheels, and accommodation of differing size wheels on some known pallets may cause the lawn mower to be elevated relative to base members of the pallet that contact a floor or ground. This can result in an elevated center-of-gravity.

Another problem arises at the retail sales center for the lawn mower. The lawn mower must be removed from the crate for display and sale. Pushing lawn mowers from the pallet requires participation of several persons, particularly if the wheels are chocked by transverse members in the pallet.

Accordingly, there is a need in the art for an improved crate for storing, handling, and shipping of riding lawn mowers to have a low center of gravity yet providing structure for readily removing the riding lawn mower from the crate. It is to such that the present invention is directed.

SUMMARY OF THE INVENTION

The present invention meets the needs in the art by providing an improved rampable crate for storing, handling, and shipping wheeled vehicles such as the illustrated riding lawn mowers. In one aspect, the present invention provides a rampable crate for a wheeled vehicle, comprising a pallet having a length and width and configured for supporting a wheeled vehicle thereon during storage and shipping of the wheeled vehicle. A top frame connected by a plurality of posts, each detachably extending in a first configuration between the pallet and the top frame so that the assembled structure of the pallet, the top frame and the plurality of posts defines a cavity therebetween for holding the wheeled vehicle. The pallet comprises a first transverse member attached at a first end of the pallet, a second transverse member attached to the pallet spaced from the first transverse member towards a second end of the pallet, and a third transverse member attached to the first end of the pallet and vertically spaced from the first transverse member to define a gap therebetween. The gap is for receiving selectively an end portion of at least two of the posts disposed in a second configuration for extending longitudinally outwardly from the pallet as a downward ramp therefrom. The pallet includes a pair of spaced-apart rails each oriented at an oblique angle relative to a longitudinal axis of the pallet, with a first end of the rail attached to a first transverse member of the pallet and an opposing second end of the rail vertically spaced below the second end relative to the pallet. The rails support respective ones of the wheels of the wheeled vehicle. The rails define an angled ramp upwardly towards the third transverse member on which the wheeled vehicle moves when being driven from the pallet. At least two of the posts being selectively disposed in a second configuration with respective ends of the at least two posts in the gap between the first and third transverse members and the at least two posts extending longitudinally outward from the pallet as a downward ramp on which the wheeled vehicle moves when being driven from the pallet.

In another aspect, the present invention provides a method of containerizing a wheeled vehicle in a rampable crate for storage and for removal therefrom, comprising the steps of:

(a) placing a wheeled vehicle on a pallet, the pallet having a length and width and configured for supporting a wheeled vehicle thereon during storage and shipping of the wheeled vehicle, the pallet comprising:

a first transverse member attached at a first end of the pallet;

a second transverse member attached to the pallet spaced from the first transverse member towards a second end of the pallet;

a third transverse member attached to the first end of the pallet and vertically spaced from the first transverse member to define a gap therebetween, the gap for receiving selectively an end portion of at least two of the posts disposed in a second configuration for extending longitudinally outwardly from the pallet as a downward ramp therefrom; and including a pair of spaced-apart rails each oriented at an oblique angle relative to a longitudinal axis of the pallet, with a first end of the rail attached to the second transverse member of the pallet and an opposing second end of the rail attached to the third transverse member of the pallet, the first end vertically spaced below the vertical spacing of the second end relative to the pallet, with the rails aligned for a respective one of the wheels of the wheeled vehicle;

(b) in a first configuration, positioning a top frame on a plurality of posts extending from the pallet to containerize the wheeled vehicle therein;

(c) shipping the containerized wheeled vehicle to a location for removal from the crate;

(d)) in a second configuration, positioning an end portion of at least two of the posts in a gap defined between the first transverse member and the third transverse member, the at least two posts extending longitudinally outwardly therefrom to define a downward ramp from the pallet in order for the wheeled vehicle to be driven on the at least two of the posts away from the pallet; and (e) driving the wheeled vehicle from the pallet, with the wheels moving on the rails that define an angled ramp upwardly towards the third transverse member.

Other objects, advantages, and features of the present invention will become readily apparent upon reading the following detailed description in conjunction with the drawings.

DETAILED DESCRIPTION

Figure 1:
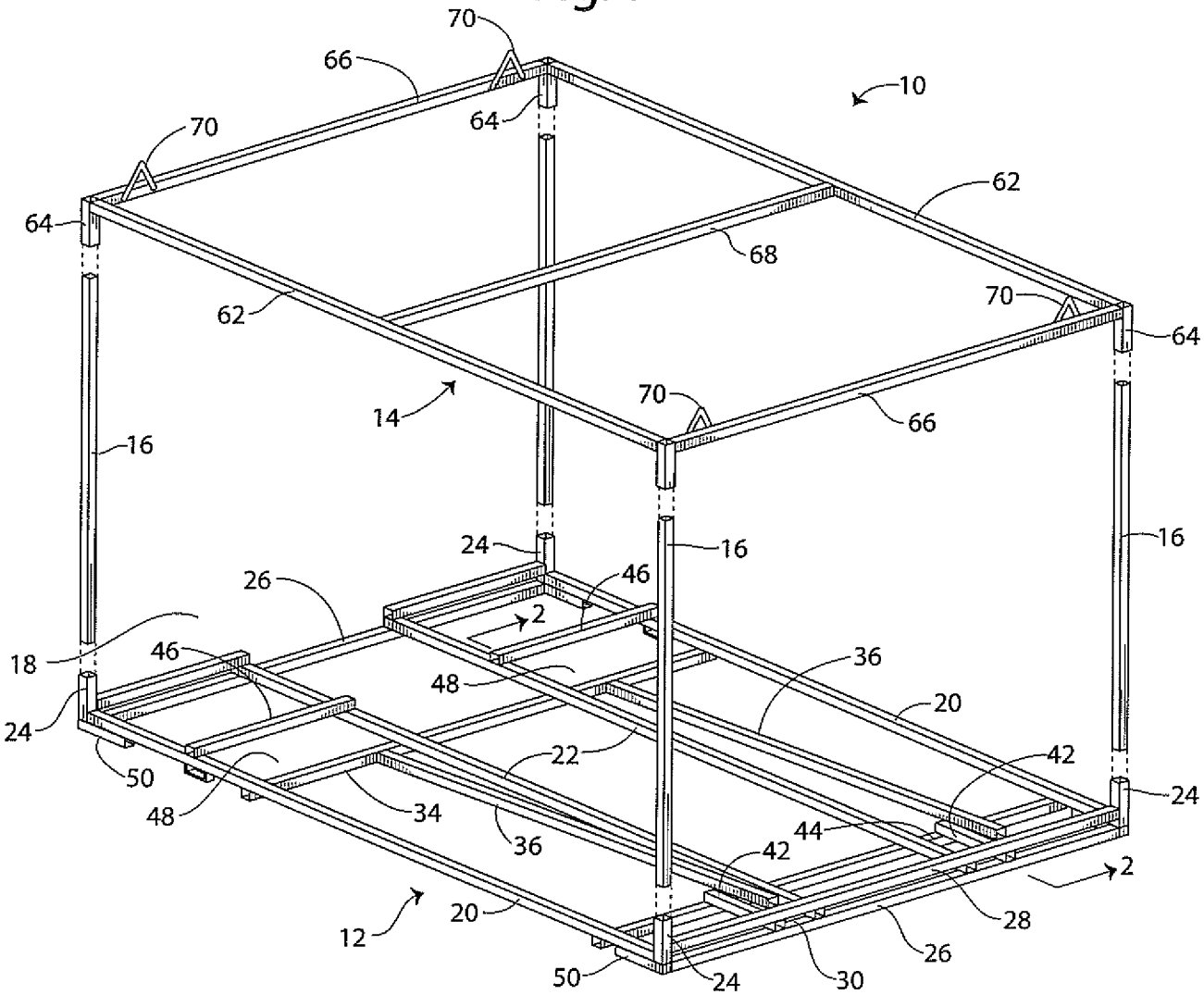
FIG. 1 illustrates in exploded perspective view a crate for riding lawn mowers according to the present invention.

With reference to the drawings in which like parts have like reference numerals, FIG. 1 illustrates in exploded perspective view a rampable crate 10 having a pallet generally 12 and opposing top frame 14 and vertical posts 16. The pallet 12 interlinks to the top frame 14 by the posts 16 to define an interior cavity generally 18 for holding an article such as a riding lawn mower 19 for storage, handling, and shipping. The riding lawn mower 19 includes a blade housing 21.

The pallet 12 includes a pair of elongated longitudinal outside members 20 and a pair of spaced-apart interior longitudinal members 22. Receiving sockets 24 attach to distal ends of the outside members 20. A lower end of the receiving socket 24 connects to a respective distal end of a lower transverse end member 26 extending between the outside members 20. An upper transverse end member 28 extends between opposing receiving sockets 24. The upper transverse end member 28 is spaced-apart from the lower transverse end member 26 to define a gap 30. The pallet can use two separate upper transverse end members as illustrated on the opposing end.

Figure 2:
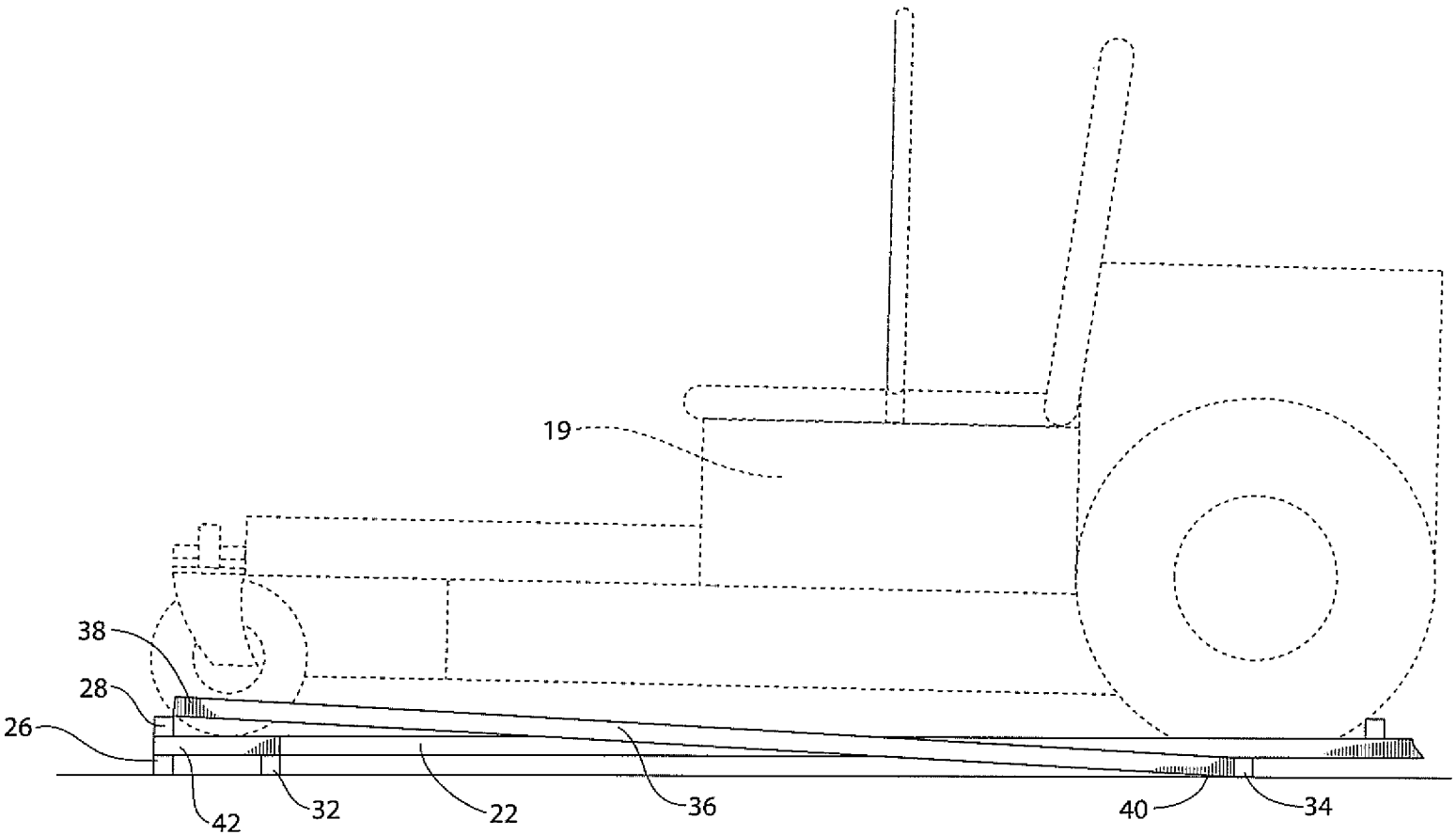
FIG. 2 illustrates a detailed side view of the pallet of the crate for riding lawn mowers illustrated in FIG. 1.

A forward transverse member 32 extends between the opposing outside members 20 and is spaced-apart from the transverse end member 26. A rear transverse member 34 also extends between the outside members 20 and is spaced-apart from the front transverse member 32. A pair of elongate interior ramp members or rails 36 connect between the upper surface of the upper transverse end member 28 and the rear transverse member 34. As best shown in side detail view in FIG. 2, this disposes the interior ramp members 36 at an oblique angle relative to a plane defined by the lower surfaces of the lower transverse end members 26, the front transverse member 32, and the rear transverse member 34. The interior ramp members 36 have first ends 38 connected to the lower transverse end member 26 and opposing second ends 40 connected to the rear transverse member 34. The first ends 38 are thereby spaced vertically higher than the opposing second ends 40, for a purpose discussed below.

With continuing reference to FIG. 1, chock members 42 connect between the lower transverse end member 26 and the front transverse member 32. The chock members 42 are disposed intermediate the respective interior ramp member 36 and the interior longitudinal member 22. Each chock member 42 and the adjacent interior ramp member 36 define a receiving space generally 44 for receiving a front wheel of the riding lawn mower 19 when seated on the pallet 12. The spacing depends upon the width of the front wheel of the riding lawn mower to be contained within the crate 10.

The interior ramp members 36 are spaced from the outside members 20 to align with the rear wheels of the riding lawn mower. A rear wheel chock member 46 extends between the outside members 20 and attaches to upper surfaces of the members 20 and the interior members 22. The rear chock member 46 and the rear transverse member 34 cooperatively define spaces 48 for seating of the rear wheels of the riding lawn mower on the pallet 12.

In the illustrated embodiment, support blocks 50 attach to respective distal ends of the outside members 20 adjacent respective distal ends of the lower transverse end members 26.

The top frame 14 includes opposing longitudinal members 62 joined at distal ends to opposing transverse end members 66, such as with one of a projecting corner lug 64. An intermediate transverse member 68 extends between the members 62. A pair of projecting members 70 attach to inward faces of the end members 66 and spaced-apart from the corner lugs 64. In the illustrated embodiment, the projections 70 are inverted V-shaped members formed by cutting and bending a steel rod.

Posts 16 extend between the pallet 12 and the top frame 14 when assembled to containerize an article held on the pallet 12. In the illustrated embodiment, the post 16 is sized for a lower end being received in the socket 24 of the pallet 12 while the opposing end of the posts receives the lug 64 projecting from the top frame 14. It is to be appreciated that other structures similarly interlock posts with sockets on pallets and top frames to form an assembled container 10 that defines the interior space 18 that receives the article held on the pallet 12. Further, the posts 16 are readily selected from posts of differing lengths, so that a group of posts in which the posts have a first length accommodate a riding lawn mover with a first vertical height, while a second group of posts have a second length to accommodate a riding lawn mower with a second vertical height.

The pallet 12 and the top frame 14 are readily assembled with elongated steel tubes welded together rigidly, or other suitable rigid members. The posts 16 also are elongated steel tubes or other suitable rigid members.

At a packing station, a finished lawn riding mower is placed on the pallet 12, for example, by using an overhead hoist, pushing the riding lawn mower onto the pallet, or other mover for seating the riding lawn mower on the pallet. The wheels are received in the respective front wheel wells 44 and rear wheel wells 48. The wheel chocks 42, 46 keep the riding lawn mower from forward and rearward movement and lateral movement. It is to be appreciated that wheeled articles placed on pallets of containers can be readily secured to the pallet, but riding lawn mowers lacking spring suspensions generally do not require such securing.

Two or more assembled containers readily stack together (not illustrated) for handling, storing, and shipping purposes. Stacking is accomplished by lifting a second one of the crates 10 and placing the second crate on top of a first one of the crates. An inner surface of the lower transverse end member 26 of the second crate 10 bears against the projecting members 70 of the top frame 14 of the first crate. The mass of the crate and its contents, cooperatively with the projecting members 70, hold the crates stacked together in routine stacking, handling, and shipping. The block 50 can abut against a side portion of a respective one of the projecting members 70. Alternate structures for stacking include attaching a plurality of projecting lugs that extend upwardly from the top frame and providing the pallet with shoes or receivers. The shoes of an upper crate align with the lugs of a lower crate. In an alternate structure, walled targets known in the trade extend upwardly from the top frame and a plurality of feet or stubs extend downwardly from the pallet. The targets of a lower crate receive a respective foot of an upper crate.

Figure 3:
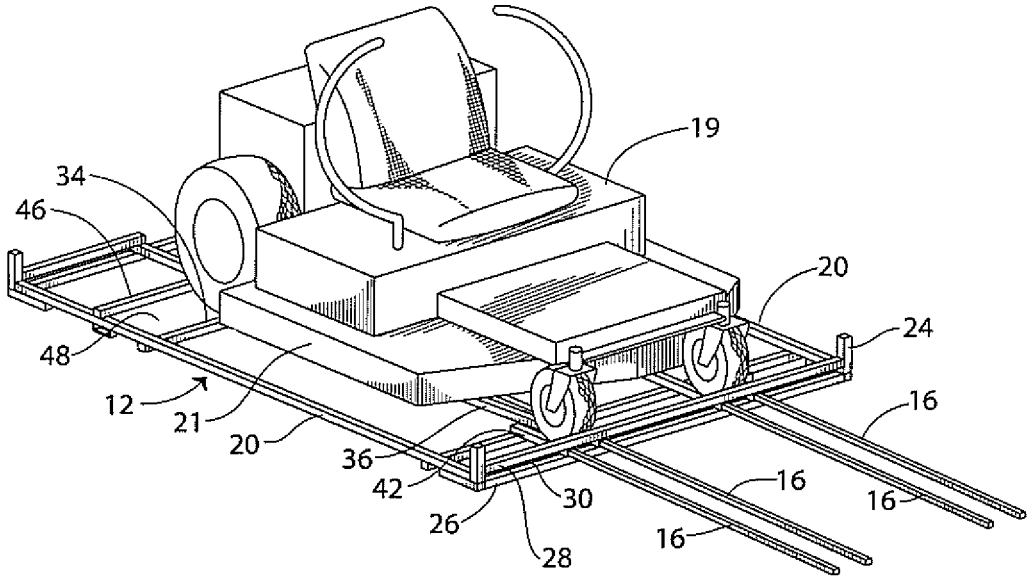
FIG. 3 illustrates in perspective view the crate illustrated in FIG. 1 with posts of the crate disposed for a ramp prior to roll off of the riding lawn mower from the pallet.

FIGS. 3-6 illustrate the operation of the crate 10 for removal of the riding lawn mower 19, such as at a retail distribution center. FIG. 3 illustrates in perspective view the crate 10 with the top frame 14 and the posts 16 removed prior to roll out of the riding lawn mower 19 from the pallet 12. The posts 16 insert into the gap 30 between the lower and upper transverse end members 26, 28 and on opposing sides of the respective interior ramp member 36. The posts 16 extend outwardly from the pallet 12 substantially parallel to a vertical plane defined by the interior ramp member 36. The posts 16 slope at an oblique angle relative to the ground downwardly from the lower transverse end member 26 to the ground.

Figure 4:
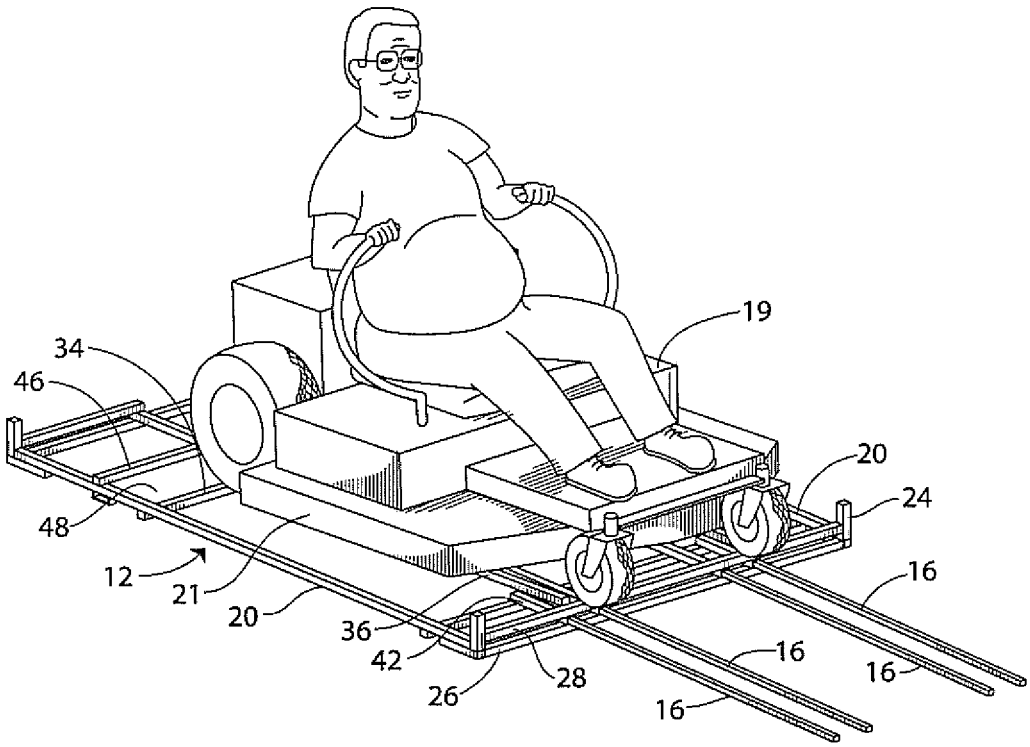
FIG. 4 illustrates in perspective view the crate with the front wheels of the riding lawn mower rolling over an upper transverse member of the pallet.

FIG. 4 illustrates in perspective view the crate 10 with the front wheels of the riding lawn mower 19 rolling over the upper transverse member 28 of the pallet 12. This is accomplished a driver starting the riding lawn mower 19 and engaging the transmission to propel the riding lawn mower forwardly. Alternative, the riding lawn mower can be pushed from the pallet 12. The front wheels move out of the chocked space 44, on to the upper transverse end member 28, and then onto the ramp defined by the posts 16.

Figure 5:
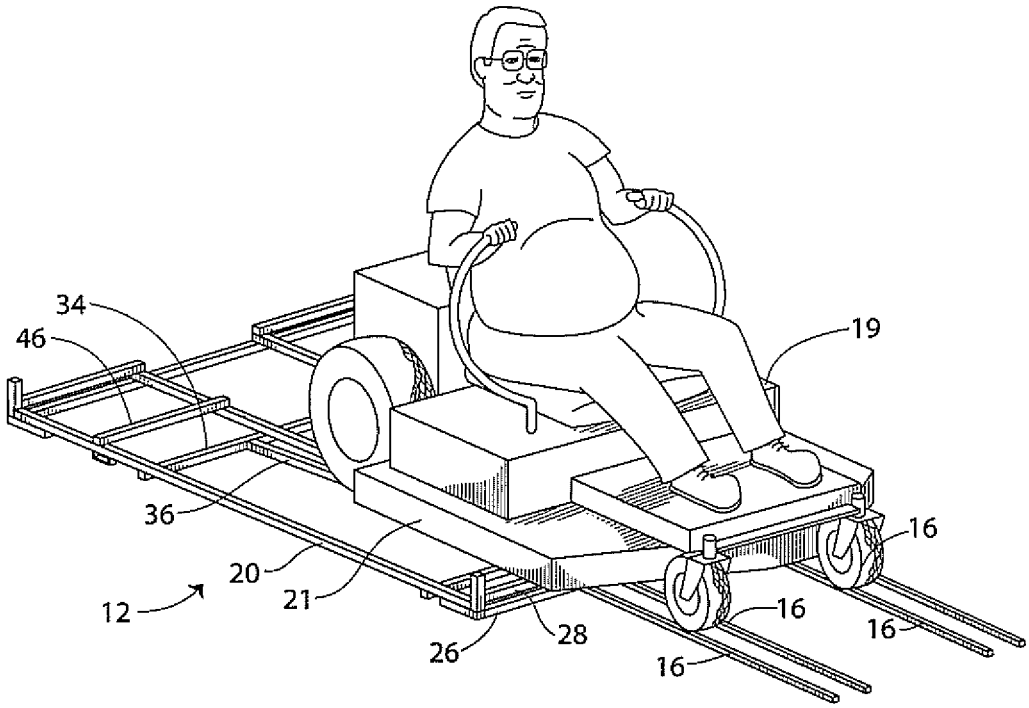
FIG. 5 illustrates in perspective view the riding lawn mower with the front wheels rolling down the ramp formed by the posts and the rear wheels rolling upwardly on a inclined member of the pallet, so that the blade housing of the riding lawn mower moves freely over the upper transverse member of the pallet.

FIG. 5 illustrates in perspective view the riding lawn mower 19 with the front wheels rolling down the ramp formed by the posts 12 and the rear wheels rolling upwardly from the space 48 on the inclined interior ramp member 36 of the pallet 12. With the front end of the riding lawn mower 19 moving downwardly on the outer ramp of the posts 16 and the back end of the riding lawn mower moving upwardly on the interior ramp member 36, the blade housing 21 of the riding lawn mower passes over the upper transverse member 28 freely. As noted above, the interior ramp member 36 is disposed centered relative to the rear tire, so that the tire of the rear wheels rolls on the ramp member as the riding lawn mower moves forwardly. As the riding lawn mower continues its forward movement, the rear wheels then contact and move over the upper transverse end member 28, and then on to the ramp formed by the posts 16.

Figure 6:
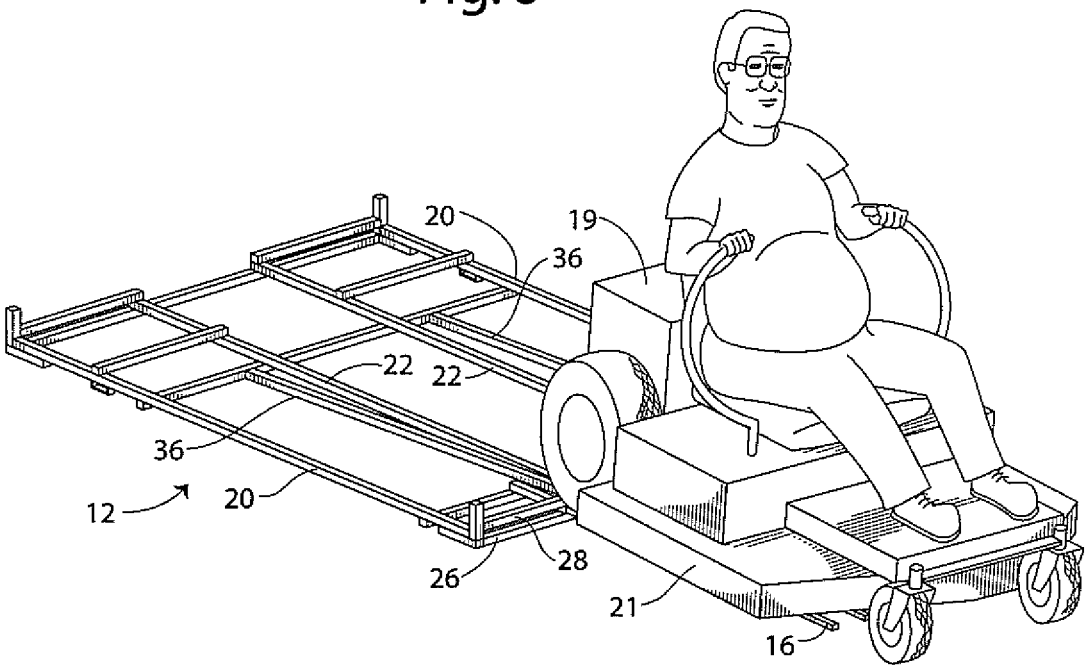
FIG. 6 illustrates in perspective view the riding lawn mower removed from the crate with the rear wheels rolling down the ramp formed by the posts.

FIG. 6 illustrates in perspective view the riding lawn mower 19 removed from the crate 10 with the rear wheels rolling down the ramp formed by the posts 16. After moving the riding lawn mower off of the ramp formed by the posts 16, the pallet 12, the top frame 14, and the posts 16 can be disposed of, for example, for recycling of the metal tube members or return to the manufacturer for re-use of the crate.

While this invention has been described in detail with particular reference to an illustrated embodiment thereof providing a crate configured readily for storing, handling, and shipping of riding lawn mowers and for removing the contained riding lawn mower therefrom, it should be understood that many modifications, additions and deletions, in additions to those expressly recited, may be made thereto without departure from the spirit and scope of the invention as set forth in the appended claims.

What is claimed is:

1. A rampable crate for a wheeled vehicle, comprising:

a pallet having a length and width and configured for supporting a wheeled vehicle thereon during storage and shipping of the wheeled vehicle;

a top frame;

a plurality of posts, each detachably extending in a first configuration between the pallet and the top frame so that the assembled structure of the pallet, the top frame and the plurality of posts defines a cavity therebetween for holding the wheeled vehicle;

the pallet comprising:

a first transverse member attached at a first end of the pallet;

a second transverse member attached to the pallet spaced from the first transverse member towards a second end of the pallet;

a third transverse member attached to the first end of the pallet and vertically spaced from the first transverse member to define a gap therebetween, the gap for receiving selectively an end portion of at least two of the posts disposed in a second configuration for extending longitudinally outwardly from the pallet as a downward ramp therefrom; and a pair of spaced-apart rails with a first end of each rail attached to the second transverse member and an opposing second end thereof attached to the third transverse member, whereby each rail is oriented at an oblique angle relative to a longitudinal axis of the pallet with the first end of the rail vertically spaced below the second end of the rail relative to the pallet, for supporting respective ones of the wheels of the wheeled vehicle thereon;

whereby the rails define a ramp angled upwardly from the second transverse member to the first end of the pallet and at least two of the posts being selectively disposed in a second configuration with respective ends of the at least two posts in the gap between the first and third transverse members and the at least two posts extending longitudinally outward from the pallet as a downward ramp on which the wheeled vehicle moves when being driven from the pallet.

2. The rampable crate as recited in claim 1, wherein the pallet further comprises a pair of opposing longitudinal side rails extending from the first end of the pallet to the second end of the pallet.

3. The rampable crate as recited in claim 1, wherein the pallet further comprises at least one transverse wheel chock member disposed spaced apart from the second transverse member, to define wheel wells for receiving wheels of the wheeled vehicle.

4. The rampable crate as recited in claim 1, wherein the posts are selected from a first group in which the posts have a first length and a second group in which the posts have a second length, the first length different from the second length, whereby wheeled vehicles having a different height can be accommodated selectively within the cavity of the crate.

5. The rampable crate as recited in claim 1, wherein the pallet includes a plurality of sockets that each receive a lower end of a respective one of the posts.

6. The rampable crate as recited in claim 5, wherein the top frame includes projecting members, and each member inserts into an open end of a respective one of the posts for seating the top frame relative to the pallet.

7. A method of containerizing a wheeled vehicle in a rampable crate for storage and for removal therefrom, comprising the steps of:

(a) placing a wheeled vehicle on a pallet, the pallet having a length and width and configured for supporting a wheeled vehicle thereon during storage and shipping of the wheeled vehicle, the pallet comprising:

a first transverse member attached at a first end of the pallet;

a second transverse member attached to the pallet spaced from the first transverse member towards a second end of the pallet;

a third transverse member attached to the first end of the pallet and vertically spaced from the first transverse member to define a gap therebetween, the gap for receiving selectively an end portion of at least two of the posts disposed in a second configuration for extending longitudinally outwardly from the pallet as a downward ramp therefrom; and a pair of spaced-apart rails each oriented at an oblique angle relative to a longitudinal axis of the pallet, with a first end of the rail attached to the second transverse member of the pallet and an opposing second end of the rail attached to the third transverse member of the pallet, the first end vertically spaced below the vertical spacing of the second end relative to the pallet, with the rails aligned for a respective one of the wheels of the wheeled vehicle;

(b) in a first configuration, positioning a top frame on a plurality of posts extending from the pallet to containerize the wheeled vehicle therein;

(c) shipping the containerized wheeled vehicle to a location for removal from the crate;

(d) in a second configuration, positioning an end portion of at least two of the posts in a gap defined between the first transverse member and the third transverse member, the at least two posts extending longitudinally outwardly therefrom to define a downward ramp from the pallet in order for the wheeled vehicle to be driven on the at least two of the posts away from the pallet; and (e) driving the wheeled vehicle from the pallet, the rails defining an angled ramp upwardly towards the third transverse member.

8. The method as recited in claim 7, further comprising the step of providing at least one transverse wheel chock member disposed spaced-apart from the second transverse end member, to define wheel wells for receiving wheels of the wheeled vehicle.

9. The method as recited in claim 7, further comprising the step of selecting the posts from a plurality of posts having at least a first length or second length, the first length different from the second length, whereby wheeled vehicles having a different height can be accommodated within the crate.

10. The method as recited in claim 7, wherein step (b) comprises positioning a lower end of the posts in a respective socket attached to the pallet and receiving in an opposing upper end of the posts a respective member projecting from the top frame.

* * * * *